United States Patent [19]

van Mullekom

[11] Patent Number: 4,541,460

[45] Date of Patent: Sep. 17, 1985

[54] SHUTTLELESS WEAVING MACHINE

[75] Inventor: Hubert P. van Mullekom, Deurne, Netherlands

[73] Assignee: Ruti-Te Strake B.V., Deurne, Netherlands

[21] Appl. No.: 411,278

[22] Filed: Aug. 25, 1982

[30] Foreign Application Priority Data

Sep. 9, 1981 [NL] Netherlands ..... 8104169

[51] Int. Cl.[4] ..... D03D 47/00; D03D 41/00

[52] U.S. Cl. ..... 139/429; 139/194; 139/302

[58] Field of Search ..... 139/194, 302, 303, 429, 139/450, 292, 294

[56] References Cited

U.S. PATENT DOCUMENTS 3,943,978 3/1976 Jindra ..... 139/292

4,296,783 10/1981 Ichimatsu ..... 139/194

FOREIGN PATENT DOCUMENTS 106527 9/1924 Switzerland ..... 139/194

*Primary Examiner*—Henry S. Jaudon

*Attorney, Agent, or Firm*—Burns, Doane, Swecker & Mathis

[57] ABSTRACT

When cutting the successive weft lengths after they have been inserted into the weaving shed, the tail ends are retained in a clamping device. Thereby shifting the weft lengths in the winding direction of the cloth is difficult. According to the invention this disadvantage is removed in that the clamping device comprises a stationary clamping element and a movable clamping element cooperating therewith and movable in the direction of the beating up movement of the reed.

1 Claim, 2 Drawing Figures

SHUTTLELESS WEAVING MACHINE

Figure 1:
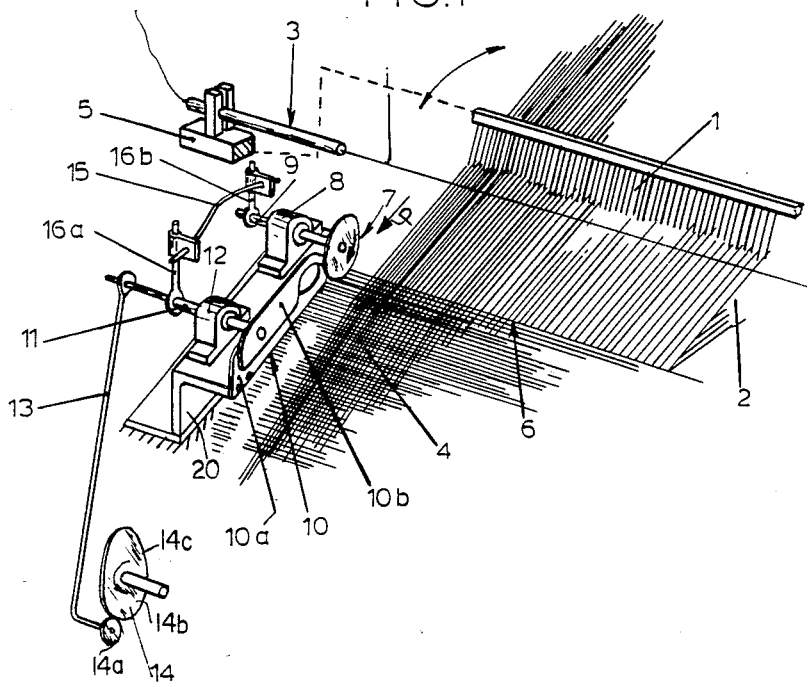

The invention relates to a shuttleless weaving machine of the type in which at the side of the intermittently operative weft conveyor, which is fed by a continuous weft yarn supply, means are provided whereby the weft threads, which are subsequently inserted into subsequent sheds, are cut and the tail ends of said weft lengths obtained thereby a caught and are retained during the beating up movement of the reed.

Such weaving machines are known in many embodiments. The means whereby the tail ends resulting from the cutting of the successive weft lengths are caught comprise therein generally a lower clamp part and an upper clamp part, between which a weft length inserted into the weaving shed first is caught during the beating up movement of the reed and thereafter is resiliently clamped. The clamping force therewith must be such that no shifting of the weft thread in the weft direction takes place under the influence of the tensioning device operating at the other side of the machine on the head end of the relative weft thread. A disadvantage of the known embodiment is that as both clamp parts have a better clamping action, shifting of the caught tail ends in the warp direction, namely in the direction in which the cloth is wound, becomes more difficult. Moreover, the cooperating clamping surfaces of both clamp parts are exposed to wear whereby the clamping force gradually decreases.

According to the invention this disadvantage is removed in that the means for catching and retaining the weft lengths are constituted by a stationary clamping element and a clamping element which is movable in the direction of the beating up movement of the reed and cooperating with the stationary clamping element.

In the device according to the invention the movable clamping element therefore functions not only as a clamping means but said element simultaneously serves for shifting the weft ends which have been caught between both clamping elements, in the direction of the beating up movement of the reed.

The ease whereby the catched weft threads are shifted in the direction of the beating up movement of the reed between both clamping elements thereby is independent of the clamping force acting between both clamping elements. The weaving machine according to the invention is thereby better suitable for handling weft yarns making very different demands with reference to the minimum clamping force which must be imparted. Therewith the clamping force may be adjusted without difficulties to such a high value that the cooperating clamp elements impart a certain temple action.

In a practical embodiment the movable clamping element is constituted by a disc which is rotatable around a shaft extending in the weft direction, the stationary clamping element extending with its effective clamping surface along part of the circumference of said disc.

In principle it is possible to drive the disc in continuous movement. However, an intermittent drive in the rhythm of and in phase with (a portion of) the reciprocating reed movement is preferable.

In a very practical embodiment in which the means for cutting the successive weft threads comprise a scissor blade secured to a reciprocatingly rotating shaft, according to a further feature of the invention the shaft of the clamp disc is connected to the shaft of the movable scissor blade such that the clamp disc shaft follows the forward rotational movement of the scissor blade but remains at standstill during the backward movement thereof.

The invention is hereunder further illustrated with reference to the drawing of an embodiment given as example.

Figure 2:
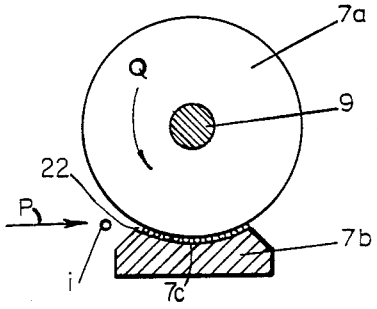

FIG. 1 shows a perspective view of the weaving machine according to the invention and FIG. 2 shows a schematic section through the rotatable clamp disc and the stationary clamp element cooperating therewith.

In FIG. 1 the reciprocatingly movable reed, the weaving shed, the weft conveyor and the woven cloth bear the reference numbers 1, 2, 3 and 4 respectively.

FIG. 1 shows the machine at a moment in which a weft thread i has just been inserted by the weft conveyor 3 into the weaving shed 2, the reed 1 carrying out its beating up movement and thereby moving the weft thread i in the direction of the beating up line 6.

Just outside the edge of the cloth at that side of the weaving machine where the weft conveyor 3 is provided, adjacent the beating up line 6, a device 7 has been provided which serves for catching the weft i, which has been displaced by the reed 1 to the line 6, and for retaining said weft during some time in the weft direction. Said device comprises an upper movable clamp element constituted by a rotatable disc *7a* and a lower stationary clamp element *7b* cooperating therewith to form a curved gap 22 therebetween (see FIG. 2). The clamp element *7b* is situated in FIG. 1 below the weft ends projecting from the cloth edge and therefore is not visible in said figure. The operative clamping surfaces of the elements *7a* and *7b* are constituted by the circumferential edge of the disc *7a* and by the concavely curved upper surface *7c* of the stationary clamp element *7b* adapted thereto. The clamping surfaces of the stationary element *7b* therein may be smooth and wear resistant, such as porcelain for example and the circumferential edge of the disc *7a* may be manufactured from a material having a relatively high coefficient of friction such as rubber for example.

The disc *7a* is secured to a shaft 9 extending parallel to the beating up line 6 and supported in a supporting bearing 8 on a stationary beam 20. The stationary element is mounted on any suitable stationary frame such as the beam 20 for example.

Likewise just outside the cloth edge, namely at the outside beside the clamp disc *7a*, a cutting device 10, known per se, is provided, comprising a stationary scissor blade 10*a* and a movable scissor blade 10*b* secured to a shaft 11. The shaft 11 extends parallel to the shaft 9 and is rotatably supported in a supporting bearing 12. During operation the shaft 11 carries out a forward and backward rotational movement under control of a lever 13 to which is intermittently imparted a reciprocating pivotal movement by a rotating cam 14, namely each time in the interval in which a newly inserted weft thread i is caught by the device 7.

In the embodiment shown in the drawing the shafts 9 and 11 have been coupled by a connecting link 15 and by two crank levers 16*a* and 16*b* respectively, each mounted to one of said shafts. The lever 13 carries a cam follower which engages the cam 14.

The shaft 11 is at stand-still during the larger part of a weaving cycle as the cam follower 14*a* engages a constant radius portion 14*b* of the cam 14. The cutting device 10 then is in its inoperative open position. The position of the active part, i.e., the portion 14*c* of non-constant radius, of the rotatable cam 14 has been chosen such that the shaft 11 starts its forward rotational movement at the moment in which the weft i taken along by the reed 1 in the direction of the beating up line 6 has arrived in the receiving zone of the device 7 which moment has been shown in FIG. 2. In other words, a base plate 5 of the weft conveyor 3 is connected in a conventional manner to a sley (not shown) which carries the reed 1. The reed 1 is movable to advance the weft thread in the direction of the beating up line. Thus, in FIG. 1 the weft i is situated at a position located to the left of arrow P in FIG. 2 preparatory to being moved horizontally by the reed 1. The forward rotational movement of the shaft 11 is combined with a rotational movement in the same direction of the shaft 9 whereby the clamp disc 7*a* is rotated in the direction of the arrow Q. During said rotational movement of the clamp disc 7*a* the weft i, which in the meantime has contacted the circumferential edge of the disc 7*a*, is frictionally taken along thereby and is shifted in the wind-up direction of the cloth along the concave supporting surface of the lower clamp element 7*b*. Thus, the shaft 9 is rotated in an oscillating manner by the lever 16*b*.

At the end of the forward rotational movement of the shaft 11 the weft, which then has been clamped between the clamp disc 7*a* and the lower clamp element 7*b*, is cut. However, the subsequent return rotational movement of the shaft 11 is not followed by the complete shaft 9. The disc 7 is connected with the shaft 9 by a one way coupling not shown in detail in the drawing, e.g. provided in the supporting bearing 8. Thereby the disc 7*a* will remain at standstill during the return rotational movement of the shaft 11 and the shaft 9. Thereby the clamp disc 7*a* is rotated intermittently in the direction of the arrow Q. The angle of rotation through which each time the disc 7*a* rotates may be adjusted to a desired value by varying the effective crank length of one or both crank levers 16*a* and 16*b*. In the embodiment shown the connecting link 15 therefore is in the embodiment of a deflectable rod clamped with its ends in blocks which are slidable in the radial direction relative to the crank levers 16*a* and 16*b* respectively.

It appears from FIG. 2 that the loose weft ends resulting from the cutting by the cutting device 10, projecting beyond the cloth edge, remain clamped during some time between the clamp disc 7*a* and the clamp element 7*b*. During this time the wefts remain fixed in the weft direction. The device 7 thereby simultaneously performs a certain temple action.

The devices present at the side remote from the weft conveyor 3, such as those for tightening and keeping taut the successive wefts and for sucking off the weft ends cut at that side, are outside the field of the present invention and therefore have not been shown.

Likewise the usual second cutting device has not been shown in FIG. 1, said device serving for cutting loose weft ends, projecting beyond the cloth edge, at a short distance from the cloth edge.

I claim:

1. In a shuttleless weaving machine of the type comprising a reed, a weft conveyor fed with a continuous weft yarn supply, said weft conveyor being movable to insert weft lengths successively into the weaving shed, cutting means for cutting tail ends of the weft lengths after insertion thereof into the weaving shed, and means for catching and retaining the weft lengths during a beating up motion performed by said reed, the improvement wherein said means for catching and retaining the weft lengths comprises a disc rotatable about an axis ending substantially parallel to the weft direction, a curved stationary clamp surface disposed opposite a portion of the periphery of said disc to define a curved gap therebetween in which the weft lengths are received and advanced, drive means for intermittently rotating said disc to advance the weft lengths within said gap in the direction of the beating up motion of said reed, said cutting means including a movable cutting element, said drive means being also interconnected to said movable element to move the latter simultaneously with the advancement of weft lengths within said gap.

* * * * *